US008297248B2

(12) United States Patent
Martin et al.

(10) Patent No.: US 8,297,248 B2
(45) **Date of Patent: *Oct. 30, 2012**

(54) EFFICIENCY ENHANCEMENT TO A LASER IGNITION SYSTEM

(75) Inventors: Douglas Raymond Martin, Canton, MI (US); Kenneth James Miller, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/273,093

(22) Filed: Oct. 13, 2011

(65) Prior Publication Data

US 2012/0055432 A1 Mar. 8, 2012

Related U.S. Application Data

(63) Continuation of application No. 12/877,886, filed on Sep. 8, 2010, now Pat. No. 8,042,510.

(51) Int. Cl.
*F02P 23/04* (2006.01)

(52) U.S. Cl. ..... 123/143 B

(58) Field of Classification Search ..... 123/143 B, 123/143 R, 145 A, DIG. 9

See application file for complete search history.

(56) References Cited

U.S. PATENT DOCUMENTS

| | | | | |
|---|---|---|---|---|
| 5,756,924 | A | 5/1998 | Early | |
| 7,532,971 | B2 | 5/2009 | Sasaki et al. | |
| 7,770,552 | B2 * | 8/2010 | Schultz | 123/143 B |
| 7,806,094 | B2 | 10/2010 | Gruber | |
| 8,042,510 | B2 * | 10/2011 | Martin et al. | 123/143 B |
| 2009/0107436 | A1 | 4/2009 | Schultz | |
| 2009/0133655 | A1 | 5/2009 | Inohara et al. | |
| 2010/0147259 | A1 * | 6/2010 | Kuhnert et al. | 123/143 B |

FOREIGN PATENT DOCUMENTS

| | | | |
|---|---|---|---|
| JP | 2005-042591 | A | 2/2005 |
| JP | 2005-291105 | A | 10/2005 |
| JP | 2006-144726 | A | 6/2006 |
| WO | 2009-040177 | A1 | 4/2009 |

OTHER PUBLICATIONS

Mullett, J.D. et al., "Multi-Cylinder Laser and Spark Ignition in an IC Gasoline Automotive Engine: A Comparative Study," SAE Technical Paper No. 2008-1-0470, 2008 World Congress, Detroit, Michigan, Apr. 14-17, 2008, 13 pages.

Furutani, Hirohide et al., "Ignition With Laser," SAE Technical Paper 20074259, Publication Date: Apr. 4, 2007, 7 pages.

* cited by examiner

*Primary Examiner* — Hieu T Vo

(74) *Attorney, Agent, or Firm* — Julia Voutyras; Alleman Hall McCoy Russell & Tuttle LLP

(57) ABSTRACT

A method for a laser ignition system to operate in at least two modes based on a four-stroke combustion cycle, wherein laser light energy is generated to ignite an air/fuel mixture for combustion and may be additionally used for heating cylinder walls, such as during a cold start, at times other than when the laser ignites an air/fuel mixture for combustion.

24 Claims, 4 Drawing Sheets

EFFICIENCY ENHANCEMENT TO A LASER IGNITION SYSTEM

CROSS REFERENCE TO RELATED APPLICATIONS

The present application is a continuation of U.S. patent application Ser. No. 12/877,886 filed Sep. 8, 2010, now U.S. Pat. No. 8,042,510 B2, issued on 25 Oct. 2011, the entire contents of which are incorporated herein by reference for all purposes.

BACKGROUND AND SUMMARY

Vehicles with internal combustion engines may utilize a laser system in the engine in various ways.

For example, U.S. Pat. No. 7,532,971 B2 describes a system including an engine control apparatus designed to control pilot injection timing based on a heat generation quantity and a fuel supply quantity in order to increase the combustion rate. An ignition device which relies on the use of an electric heater (glow plug) or an electromagnetic action such as a laser for locally shifting the energy level of an in-cylinder atmosphere to a higher side to thereby facilitate ignition, is also described.

The inventors herein have recognized various issues with the above system. In particular, raising the energy level of the in-cylinder atmosphere with the laser may cause ignition earlier than desired under some conditions where too much energy is provided. Likewise, providing too littler energy may be insufficient to obtain reliable compression ignition.

As such, one approach to address the above issues is to focus the laser energy at different locations within the cylinder. By changing the focus location for different actions, one location for ignition and a second, different, location for heating (such as the peripheral cylinder wall), for example, it is possible to obtain reliable ignition while also achieving more rapid engine warm-up, and thus reduced friction. Furthermore, the laser operation at the first location may be performed at a different timing of the combustion cycle. In this way, the combustion cylinder wall may be heated at a time without interfering with ignition timing.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to a method for a laser ignition system that advantageously uses the laser for both igniting an air/fuel mixture and more rapidly heating the cylinder to reduce friction. Frictional losses associated with cold cylinder walls, such as during a cold start, correlate to a decrease in combustion efficiency and therefore a decrease in fuel economy. The disclosed method focuses a laser to different positions within the cylinder, and further, focuses a laser during different strokes or timing of the combustion cycle. While the laser is utilized as an ignition source during the power stroke, the laser additionally functions to heat the cylinder walls, for example prior to air/fuel combustion (during an intake stroke) and/or following combustion (during the exhaust stroke). Various approaches to change the focus of the laser may be used. For example, the laser may be repositioned such that the directionality of the laser point source is changed to access different regions of the cylinder. As another example, the laser beam may be directed to different positions within the cylinder with the aid of one or more reflectors. Additionally, the laser exciter may change the laser defining characteristics, such as the duration, frequency, period and magnitude of the laser energy, depending on the combustion cycle stroke and/or the operational state of the vehicle.

Figure 1:
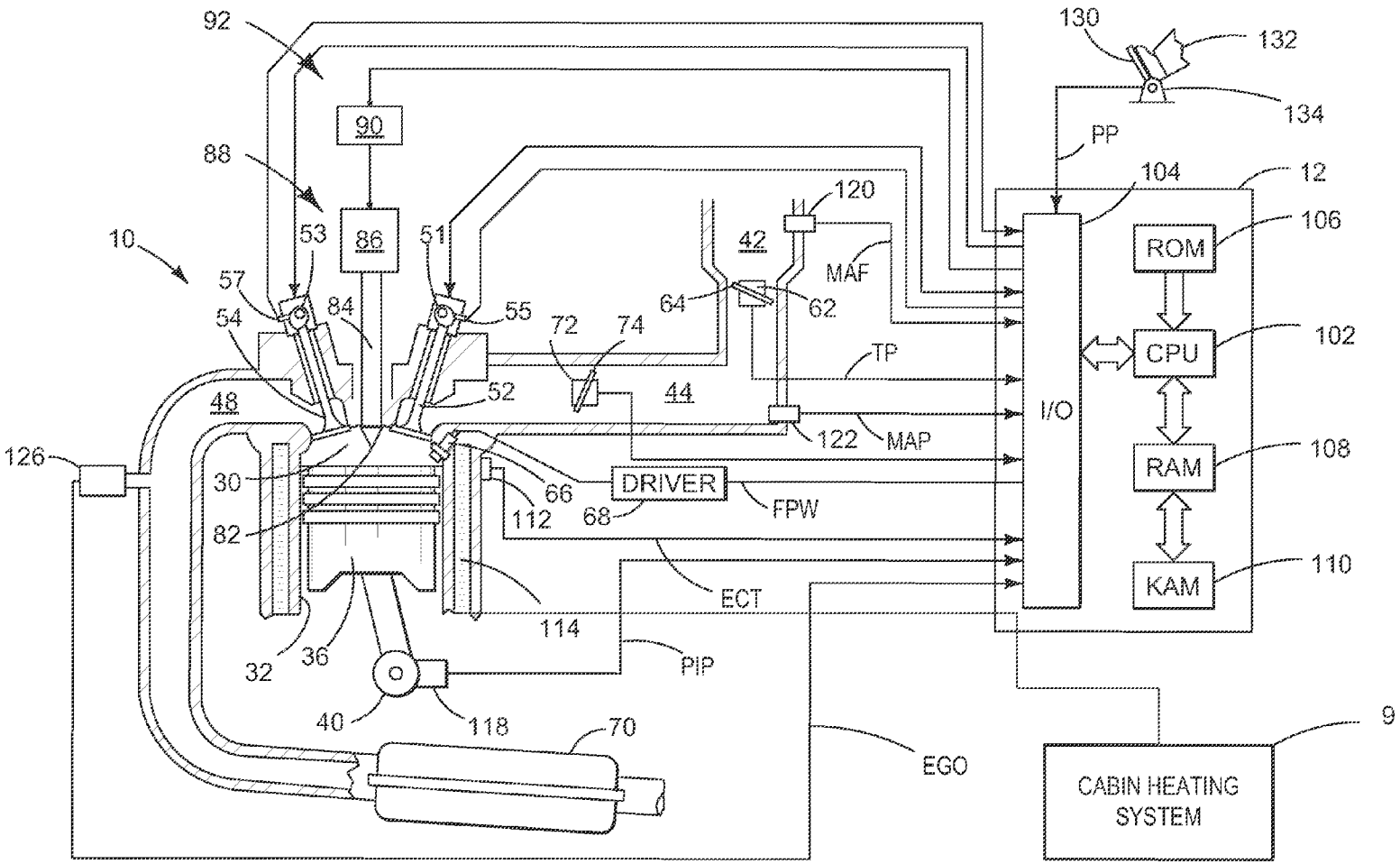
FIG. 1 is a schematic diagram of an internal combustion engine.
Figure 2:
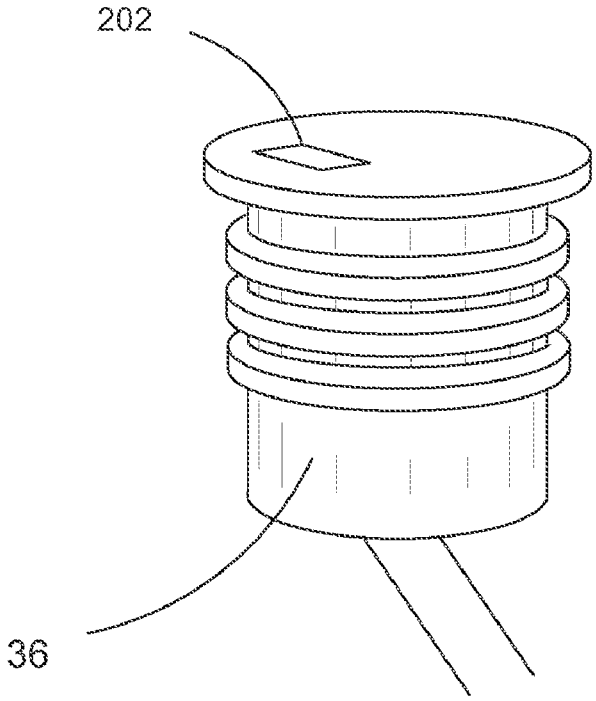
FIG. 2 is a schematic diagram of an example piston.
Figure 3A:
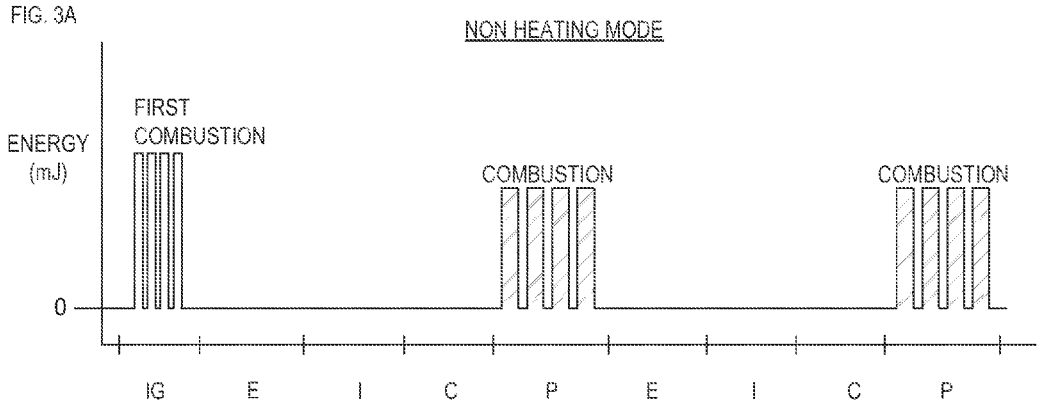
FIG. 3A is a chart depicting a non heating mode.
Figure 3B:
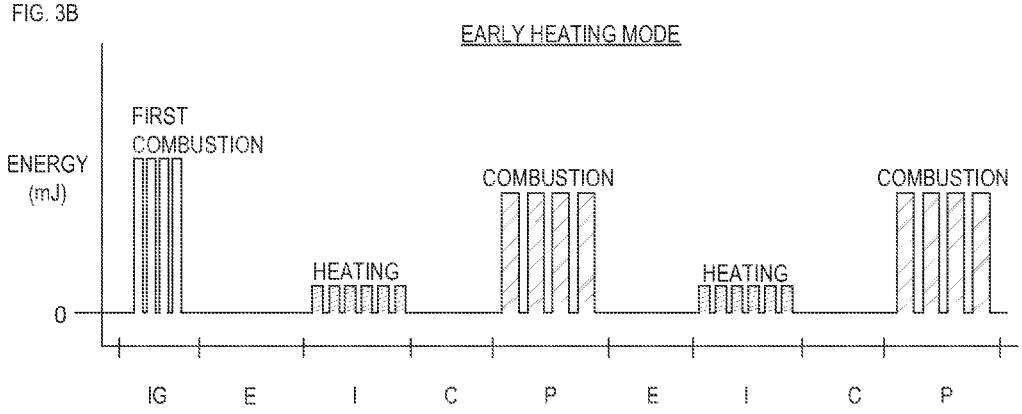
FIG. 3B is a chart depicting an early heating mode.
Figure 3C:
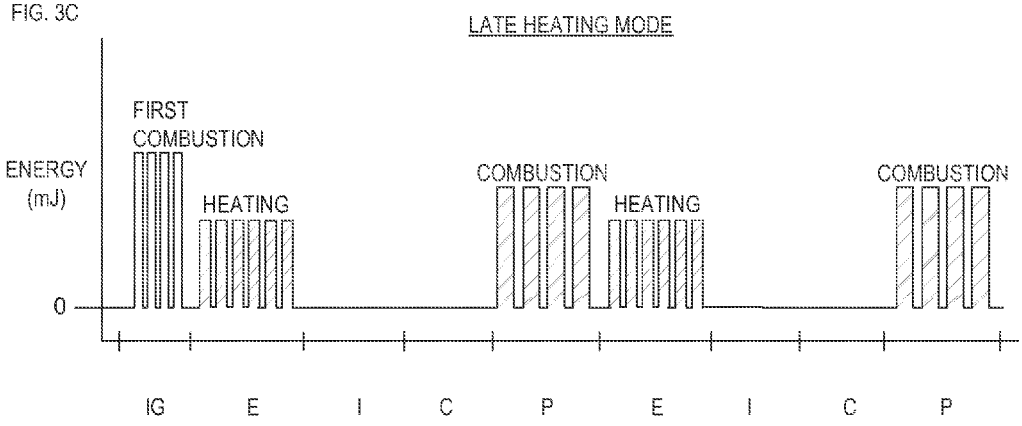
FIG. 3C is a chart depicting a late heating mode.

An example internal combustion engine is depicted in FIG. 1. FIG. 2 shows an example engine piston for the example embodiment where the laser position is changed via movement of a reflective region. FIGS. 3A-C show various laser operation modes, and FIG. 4 describes various methods for controlling system operation, including laser ignition and laser heating.

Referring specifically to FIG. 1, it includes a schematic diagram showing one cylinder of multi-cylinder internal combustion engine 10. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Combustion cylinder 30 of engine 10 may include combustion cylinder walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion cylinder 30 may receive intake air from intake manifold 44 via intake passage 42 and may exhaust combustion gases via exhaust passage 48. Intake manifold 44 and exhaust passage 48 can selectively communicate with combustion cylinder 30 via respective intake valve 52 and exhaust valve 54. In some embodiments, combustion cylinder 30 may include two or more intake valves and/or two or more exhaust valves.

In this example, intake valve 52 and exhaust valve 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion cylinder 30 for injecting fuel directly therein in proportion to the pulse width of signal FPW received from controller 12 via electronic driver 68. In this manner, fuel injector 66 provides what is known as direct injection of fuel into combustion cylinder 30. The fuel injector may be mounted on the side of the combustion cylinder or in the top of the combustion cylinder, for example. Fuel may be delivered to fuel injector 66 by a fuel delivery system (not shown) including a fuel tank, a fuel pump, and a fuel rail. In some embodiments, combustion cylinder 30 may alternatively or additionally include a fuel injector arranged in intake passage 42 in a configuration that provides what is known as port injection of fuel into the intake port upstream of combustion cylinder 30.

Intake passage 42 may include a charge motion control valve (CMCV) 74 and a CMCV plate 72 and may also include a throttle 62 having a throttle plate 64. In this particular example, the position of throttle plate 64 may be varied by controller 12 via a signal provided to an electric motor or actuator included with throttle 62, a configuration that may be referred to as electronic throttle control (ETC). In this manner, throttle 62 may be operated to vary the intake air provided to combustion cylinder 30 among other engine combustion cylinders. Intake passage 42 may include a mass air flow sensor 120 and a manifold air pressure sensor 122 for providing respective signals MAF and MAP to controller 12.

Exhaust gas sensor 126 is shown coupled to exhaust passage 48 upstream of catalytic converter 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. The exhaust system may include light-off catalysts and underbody catalysts, as well as exhaust manifold, upstream and/or downstream air-fuel ratio sensors. Catalytic converter 70 can include multiple catalyst bricks, in one example. In another example, multiple emission control devices, each with multiple bricks, can be used. Catalytic converter 70 can be a three-way type catalyst in one example.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. The controller 12 may receive various signals and information from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Storage medium read-only memory 106 can be programmed with computer readable data representing instructions executable by processor 102 for performing the methods described below as well as variations thereof. The engine cooling sleeve 114 is coupled to the cabin heating system 9.

Laser ignition system 92 includes a laser exciter 88 and a laser control unit (LCU) 90. LCU 90 causes laser exciter 88 to generate laser energy. LCU 90 may receive operational instructions from controller 12. Laser exciter 88 includes a laser oscillating portion 86 and a light converging portion 84. The light converging portion 84 converges laser light generated by the laser oscillating portion 86 on a laser focal point 82 of combustion cylinder 30.

Laser ignition system 92 is configured to operate in more than one capacity with the timing of each operation based on engine position of a four-stroke combustion cycle. For example, laser energy may be utilized for igniting an air/fuel mixture during a power stroke of the engine, including during engine cranking, engine warm-up operation, and warmed-up engine operation. Fuel injected by fuel injector 66 may form an air-fuel mixture during at least a portion of an intake stroke, where igniting of the air/fuel mixture with laser energy generated by laser exciter 88 commences combustion of the otherwise non-combustible air/fuel mixture and drives piston 36 downward.

LCU 90 may direct laser exciter 88 to focus laser energy at different locations depending on operating conditions. For example, the laser energy may be focused at a first location away from cylinder wall 32 within the interior region of cylinder 30 in order to ignite an air/fuel mixture. In one embodiment, the first location may be near top dead center of a power stroke. Further, LCU 90 may direct laser exciter 88 to generate a first plurality of laser pulses directed to the first location, and the first combustion from rest may receive laser energy from laser exciter 88 that is greater than laser energy delivered to the first location for later combustions.

Laser energy may be used in another capacity for heating, in addition to using laser energy for igniting an air/fuel mixture. Using laser ignition system 92 for heating may occur selectively and may be performed in response to a temperature, for example the engine coolant temperature (ECT). In one example, LCU 90 may direct laser exciter 88 to generate a second plurality of laser pulses greater than the first plurality of laser pulses at a second location different from the first location. The second location may include cylinder wall 32 and laser energy may be focused at the second location during an exhaust stroke of the four-stroke combustion cycle. As another example, the second location may include an intake stroke.

Controller 12 controls LCU 90 and has non-transitory computer readable storage medium including code to adjust the location of laser energy delivery based on temperature, for example the ECT. Laser energy may be directed at different locations within cylinder 30. Controller 12 may also incorporate additional or alternative sensors for determining the operational mode of engine 10, including additional temperature sensors, pressure sensors, torque sensors as well as sensors that detect engine rotational speed, air amount and fuel injection quantity. Additionally or alternatively, LCU 90 may directly communicate with various sensors, such as temperature sensors for detecting the ECT, for determining the operational mode of engine 10.

As described above, FIG. 1 shows only one cylinder of a multi-cylinder engine, and each cylinder may similarly include its own set of intake/exhaust valves, fuel injector, laser ignition system, etc.

FIG. 2 illustrates an example of a piston 36 which may be included in engine 10. The piston of FIG. 2 includes a movable reflective region 202, shown herein as located on the top surface of piston 36. Movable reflective region 202 may be of a variety of suitable sizes or shapes that can be accommodated by piston 36 and cylinder 30. Additionally, piston 36 may be associated with more than one movable reflective region 202. To facilitate a greater distribution of laser light energy throughout combustion cylinder 30, one or more reflective regions 202 may assist laser ignition system 92 with heating cylinder wall 32 by redirecting laser light energy to a plurality of different cylinder locations. The dynamic nature of the one or more reflective regions 202 allows the reflective regions 202 to be utilized in some situations (e.g., during heating) and inaccessible in other situations (e.g., during combustion or when heating is no longer advantageous), although in another embodiment, the one or more reflective regions 202 may be static yet non-obstructive to laser exciter 88 focusing laser energy at the first position for igniting an air/fuel mixture. One or more reflective regions 202 may be positioned elsewhere within combustion cylinder 30 to assist with the redirection of laser light energy and thus facilitate a greater distribution of laser light energy within combustion cylinder 30. Alternatively, in another embodiment, the laser exciter 88 may generate a plurality of laser pulses without the aid of reflective regions 202 present within combustion cylinder 30.

FIG. 3 illustrates three different operational modes of laser ignition system 92; although it is to be understood that additional operational modes may be associated with laser ignition system 92. With reference to FIG. 1, each cylinder 30 in a multi-cylinder engine 10 operates on a four-stroke combustion cycle. Following a first combustion, or ignition of engine 10, the four-stroke combustion cycle begins with an intake stroke including an injection of an air/fuel mixture during at least a portion of the intake stroke. The subsequent stroke is a compression stroke in which piston 36 compresses the air/fuel mixture, which in turn, is followed by the combustion or power stroke. During the power stroke, piston 36 approaches top dead center and the air/fuel mixture is ignited by a plurality of laser pulses generated by laser exciter 88. The combustion of the air/fuel mixture drives piston 36 downward. The fourth and final component of the four-stroke combustion cycle is an exhaust stroke in which the combustion cylinder contents exit through the one or more exhaust valves 54 before reaching catalytic converter 70 and exiting through the tail pipe.

FIG. 3 shows three different example modes of laser ignition system 92 depicting the frequency of laser pulses generated by laser exciter 88 in relation to the combustion cycle, which begins with an engine startup. Engine startup in FIG. 3A-C includes a first combustion or ignition (IG) during a cranking operation, followed by engine speed run-up. A cranking operation may involve engine 10 reaching 50 rpm, followed by a first combustion IG, for example. During first combustion IG, laser exciter 88 generates a plurality of laser pulses at a higher energy level, relative to later combustions. Following a first combustion IG, engine 10 may have one or more combustions before settling down to idle. The following is a detailed discussion of each example mode.

FIG. 3A is an example of laser ignition system 92 operating in a non heating mode. When laser exciter 88 is instructed by LCU 90 to generate a first plurality of laser pulses in a non heating mode, laser exciter 88 focuses laser light energy at a first location to commence combustion during a first portion of the combustion cycle, for example, near top dead center of a power stroke (P), and laser exciter 88 remains dormant during the intake (I), compression (C) and exhaust (E) strokes. Laser exciter 88 generates a first plurality of laser pulses during power stroke P at an energy level lower than the first combustion IG. The combustion cycle continues in the order of intake stroke I, compression stroke C, power stroke P, and exhaust stroke E before beginning again with intake stroke I, all the while with laser exciter 88 generating a first plurality of laser pulses during power stroke P for combustion. The energy level of the first plurality of laser pulses may vary from power stroke P to power stroke P depending on the engine speed and air/fuel ratio, as configured by controller 12. For example, a leaner air/fuel mixture may operate with a higher laser energy level than a less lean, or more rich air/fuel mixture in order to combust the lean air/fuel mixture more efficiently, and lower engine speeds may be associated with a poor mixture of air and fuel, and therefore may also benefit from a higher laser energy level than higher engine speeds in order to improve combustion.

FIG. 3B is an example of laser ignition system 92 operating in a first mode, or early heating mode. Similar to the non heating mode described in FIG. 3A, the early heating mode is comprised of laser exciter 88 generating a first plurality of laser pulses during a first portion of the combustion cycle, such as a power stroke P for igniting an air/fuel mixture for combustion. Some engine conditions may allow laser exciter 88 to generate a second plurality of laser pulses greater than the first plurality, during an earlier portion of the combustion cycle, such as during intake stroke I. For example, during cold start conditions. When laser exciter 88 is instructed by LCU 90 to operate in an early heating mode, laser exciter 88 focuses a first plurality of laser light energy at a first location near top dead center of a power stroke (P), and laser exciter 88 focuses a second plurality, greater than the first plurality, of laser light energy at a second location, different from the first location, the second location including cylinder wall 32 during intake stroke I. The combustion cycle continues in the order of intake stroke I, compression stroke C, power stroke P, and exhaust stroke E before beginning again with intake stroke I, all the while with laser exciter 88 generating a second plurality of laser pulses during intake stroke I for heating and a first plurality of laser pulses during power stroke P for combustion. The energy level of the second plurality of laser pulses generated during intake stroke I is lower, relative to the energy level of the first plurality of laser pulses generated during power stroke P, the particular energy level of the second plurality of laser pulses generated during intake stroke I being dependent on the catalyst temperature. For example, a higher laser energy level during intake stroke I would correspond to a lower catalytic converter 70 temperature (e.g., below a light-off temperature) as opposed to a higher catalytic converter 70 temperature, which would correspond to a lower laser energy level during intake stroke I. Additionally, the duration of the second plurality of laser pulses generated during intake stroke I may vary with engine temperature and/or engine speed. For example, the duration of the second plurality of laser pulses during intake stroke I may be longer when the engine temperature is lower than a threshold or when the engine speed is lower than a threshold. Likewise, the duration of the second plurality of laser pulses generated during intake stroke I may be shorter when the engine temperature is higher or when the engine speed is higher.

FIG. 3C is an example of laser ignition system 92 operating in a second mode, or late heating mode. Similar to the non heating mode described in FIG. 3A and the first mode, or early heating mode described in FIG. 3B, the late heating mode is comprised of laser exciter 88 generating a first plurality of laser pulses during a first portion of the combustion cycle, such as a power stroke P for igniting an air/fuel mixture for combustion. Some engine conditions may allow laser exciter 88 to generate a second plurality of laser pulses during a later portion of the combustion cycle, such as during exhaust stroke E. For example, during cold start conditions in which the generation of a second plurality of laser pulses during intake stroke I is not sufficient for a timely engine warm-up, a generation of a second plurality of laser pulses during exhaust stroke E may occur. Since the air/fuel mixture is injected into combustion cylinder 30 during intake stroke I via fuel injector 66, there is a finite level of laser light energy that can be utilized so as to avoid an early combustion of the air/fuel mixture, which can lead to engine knock and/or pre-ignition. Therefore, it may be advantageous under selected engine conditions (e.g., warmer ambient conditions), to utilize laser ignition system 92 to heat cylinder wall 32 during exhaust stroke E, when a greater laser light energy level can be achieved. When laser exciter 88 is instructed by LCU 90 to operate in a late heating mode, laser exciter 88 focuses a first plurality of laser light energy at a first location near top dead center of a power stroke (P), and laser exciter 88 focuses a second plurality of laser light energy, greater than the first plurality, at a second location, different from the first location, the second location including cylinder wall 32 during exhaust stroke E. Additionally, the second plurality of laser energy generated during the late heating mode is greater than the second plurality of laser energy generated during the early heating mode. The combustion cycle continues in the order of intake stroke I, compression stroke C, power stroke P, and exhaust stroke E before beginning again with intake stroke I, all the while with laser exciter 88 generating a first plurality of laser pulses during power stroke P for combustion and generating a second plurality of laser pulses during exhaust stroke E for heating. The energy level of a second plurality of laser pulses generated during exhaust stroke E is lower, relative to the energy level of a first plurality of laser pulses generated during power stroke P, the particular energy level of a second plurality of laser pulses generated during exhaust stroke E being dependent on the catalytic converter 70 temperature, similar to the conditions previously described for the first mode, or early heating mode. Additionally, the duration of a second plurality of laser pulses generated during exhaust stroke E may vary with engine temperature and/or engine speed, also as previously described for the first mode, or early heating mode.

It will be appreciated that laser ignition system 92 may operate in additional modes with varying combinations of utilizing laser light energy for combustion and heating with varying frequencies, durations and magnitudes of laser light energy throughout the different strokes of the four-stroke combustion cycle. For example, a cold start condition may benefit from the generation of laser light pulses prior to the first combustion IG from rest to heat cylinder wall 32. For example, the laser heating may occur during engine rest prior to an engine start request. Further, engine conditions may benefit from laser exciter 88 generating laser pulses during both intake stroke I and exhaust stroke E for heating, in addition to power stroke P for combustion. Additional examples of laser ignition system operation are discussed further in reference to FIG. 4.

Figure 4:
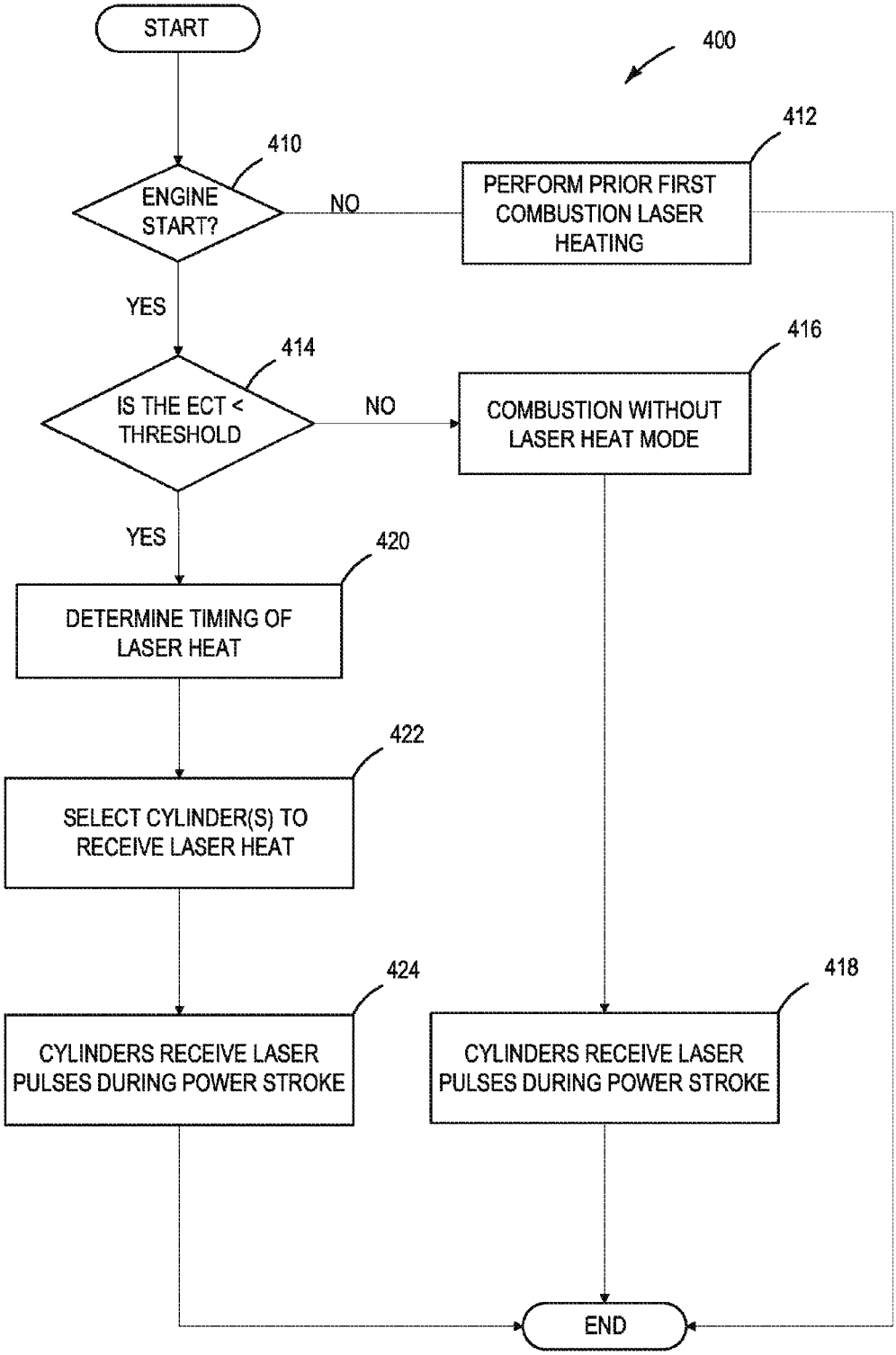
FIG. 4 is a flow chart illustrating a method to operate laser ignition.

FIG. 4 is a flow chart illustrating method 400; an example configuration of LCU 90 responding to the operational state of internal combustion engine 10, such as a cold start, and dictating one or more heating modes, causing laser exciter 88 to generate a plurality of laser pulses according to the particular heating mode.

As shown in FIG. 4 and with reference to FIG. 1, method 400 first determines whether an engine starting operation is present at 410. Engine starting operation may include engine cranking operation and engine speed run-up. If the answer to 410 is NO, method 400 continues to 412 to perform laser heating of cylinder walls 32, for example, under selected conditions, such as before a first combustion event from rest when engine starting is imminent. Imminent engine starting may be signaled via an engine start-stop controller that automatically starts the engine in response to a driver release of a brake pedal, for example. The laser heating may include focusing the laser at a position, such as cylinder wall 32 and laser exciter 88 may generate a plurality of laser pulses directed at cylinder wall 32. From 412, method 400 continues to the end and repeats.

When the answer to 410 is YES, method 400 continues to 414 to determine whether the engine coolant temperature ECT is less than a threshold, where the threshold may be set to the ambient temperature but may also be set to a specific temperature, for example 100° F. If the answer to 414 is NO, method 400 continues to 416 to perform combustion without a laser heating mode before or after combustion. From 416, the method continues to 418 in which cylinders receive laser pulses during the power stroke for combustion. For example, 418 may entail laser exciter 88 generating a first plurality of laser pulses aimed at a first location (such as within the combustion chamber away from the walls) at a desired ignition timing, such as near top dead center of a power stroke, in order to ignite an air/fuel mixture for combustion. From 418, method 400 continues to the end and repeats.

When the answer to 414 is YES, method 400 continues to 420 to determine a timing of laser heating, such as early in the combustion cycle, late in the combustion cycle, or combinations thereof. The timing of heating may be based on various factors, such as engine speed, engine air/fuel ratio, engine coolant temperature, and others. For example, at lower engine speeds, laser exciter 88 may generate laser pulses during both early and late strokes of the combustion cycle for heating, as opposed to higher engine speeds which may correlate to laser exciter 88 generating laser pulses during a late stroke for heating without generating laser pulses during an early stroke, wherein an early stroke may be an intake stroke and a late stroke may be an exhaust stroke. Further, some engine conditions may involve laser exciter 88 generating laser pulses during an early stroke for heating without generating laser pulses during a late stroke for heating. Controller 12 determines which cylinders in multi-cylinder engine 10 will receive laser pulses for heating based on, for example, the temperature of each cylinder 30. The laser heating during an early stroke or a late stroke may include focusing the laser pulses at a second location, different from the first location and laser exciter 88 may generate a second plurality of laser pulses, greater than the first plurality aimed at the second location. LCU 90 communicates with each laser exciter 88 of each cylinder 30 independently to facilitate two or more different laser heating timing modes concurrently in different combustion cylinders.

For example, at a given time some cylinders may be receiving laser heat during an intake stroke, while other cylinders may receive laser heat during an exhaust stroke. Further still, at a given time some cylinders may receive laser heat while other cylinders may not receive laser heat. In one example, controller 12 may determine that the four end cylinders in a V8 configuration will receive laser pulses for heating while the remaining interior cylinders do not receive laser pulses for heating. Once the timing of laser heat is determined, method 400 continues to 422 in which the timing of laser heat is executed appropriately in the cylinders selected to receive laser heat, when again, some cylinders may be elected to not receive laser heat.

From 422, method 400 continues to 424 in which cylinders receive laser pulses during the power stroke for combustion. For example, 424 may entail laser exciter 88 generating a first plurality of laser pulses aimed at a first location (such as within the combustion chamber away from the walls) at a desired ignition timing, such as near top dead center of a power stroke in order to ignite an air/fuel mixture for combustion. From 424, method 400 continues to the end and repeats.

It will be appreciated that controller 12 may instruct LCU 90 to operate in additional or alternative methods, and may base these instructions on additional or alternative sensors. For example, controller 12 may utilize readings from additional temperature sensors, pressure sensors, torque sensors, as well as sensors for engine speed and air/fuel mixture ratios in each cylinder 30. FIG. 4 is presented as one example of how LCU 90 may respond to controller 12 and execute the received instructions to use laser ignition system 92 for heating and/or combustion. In other examples, the amount of laser energy and/or number of pulses for laser heating of the cylinder wall may vary depending on whether the early or late heating mode is selected, as described herein.

The preceding description supports methods for a laser ignition system that may advantageously use a laser for both igniting an air/fuel mixture and heating a cylinder. By reducing the frictional losses associated with cold cylinder walls, such as during a cold start, the combustion efficiency and likewise the fuel economy increases. While broadly applicable to a vehicle, the disclosed method is additionally beneficial towards vehicles associated with engines that do not turn over at the beginning of the cold start procedures, such as in the case of hybrid vehicles.

It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a laser ignition in an engine cylinder, comprising:

during an engine start, igniting an air/fuel mixture in the cylinder by focusing a laser at a first cylinder location; and heating the cylinder with laser energy by focusing the laser at a second cylinder location different from the first cylinder location when engine temperature is less than a threshold, the heating including generating laser pulses during an exhaust stroke of the cylinder.

2. The method of claim 1 wherein the second location includes a cylinder wall.

3. The method of claim 2 wherein the first location includes away from the cylinder wall within an interior region of the cylinder.

4. The method of claim 1 wherein the igniting of the air/fuel mixture includes commencing combustion of the otherwise non-combusting air/fuel mixture, where the air/fuel mixture is formed by injecting fuel into the cylinder during an intake stroke.

5. The method of claim 1 further comprising:

generating a first plurality of laser pulses at the first cylinder location; and generating a second plurality of laser pulses at the second cylinder location, the second plurality greater than the first plurality.

6. The method of claim 1 wherein during a four-stroke combustion cycle, the laser is focused at the second location during an exhaust stroke of the cycle, and the laser is focused at the first location near top dead center of a power stroke of the cycle.

7. The method of claim 1 wherein during a four-stroke combustion cycle, the laser is also focused at the second location during an intake stroke of the cycle.

8. The method of claim 1 wherein an amount of laser energy provided at the first location is greater than at the second location.

9. The method of claim 1 where an amount of laser energy provided at the first location is greater during a first combustion of the cylinder than at a later combustion cycle of the cylinder for the engine start.

10. The method of claim 1 wherein a timing of laser operation is based on engine position.

11. The method of claim 1 wherein the igniting of the air/fuel mixture occurs during an engine cranking operation.

12. The method of claim 1 wherein a duration of heating at the second location is based on engine temperature, where a shorter duration occurs at a higher temperature than at a lower temperature.

13. The method of claim 1 wherein a duration of heating at the second location is based on engine speed, where a shorter duration occurs at a higher speed than at a lower speed.

14. A method for a laser ignition in an engine cylinder, comprising:

during an engine start, igniting an air/fuel mixture in the cylinder by focusing a laser at a first cylinder location; and heating the cylinder with laser energy by focusing the laser at a second cylinder location different from the first cylinder location, a heating duration at the second location being shorter at higher speeds than at lower speeds.

15. The method of claim 14 wherein the second location includes a cylinder wall.

16. The method of claim 15 wherein the first location includes away from the cylinder wall within an interior region of the cylinder.

17. The method of claim 14 wherein the igniting of the air/fuel mixture includes commencing combustion of the otherwise non-combusting air/fuel mixture, where the air/fuel mixture is formed by injecting fuel into the cylinder during an intake stroke.

18. The method of claim 14 further comprising:

generating a first plurality of laser pulses at the first cylinder location; and generating a second plurality of laser pulses at the second cylinder location, the second plurality greater than the first plurality.

19. The method of claim 14 wherein during a four-stroke combustion cycle, the laser is focused at the second location during an exhaust stroke of the cycle, and the laser is focused at the first location near top dead center of a power stroke of the cycle.

20. The method of claim 14 wherein during a four-stroke combustion cycle, the laser is focused at the second location during an intake stroke of the cycle.

21. The method of claim 14 wherein an amount of laser energy provided at the first location is greater than at the second location.

22. The method of claim 14 where an amount of laser energy provided at the first location is greater during a first combustion of the cylinder than at a later combustion cycle of the cylinder for a given engine start.

23. The method of claim 14 wherein a timing of laser operation is based on engine position.

24. The method of claim 14 wherein the igniting of the air/fuel mixture occurs during an engine cranking operation, and wherein the heating is selectively performed responsive to engine temperature.

* * * * *